United States Patent [19]

Baginski et al.

[11] Patent Number: 4,713,508

[45] Date of Patent: Dec. 15, 1987

[54] CIRCUIT BREAKER OPERATING MECHANISM EQUIPPED WITH A STORED ENERGY SYSTEM HAVING REMOVABLE AND REPLACEABLE CLOSING SPRING MECHANISMS

[75] Inventors: Pierre Baginski, Grenoble; Jean-Pierre Nebon, St Martin-le-Vinoux, both of France

[73] Assignee: Merlin Gerin, Grenoble, France

[21] Appl. No.: 919,427

[22] Filed: Oct. 16, 1986

[30] Foreign Application Priority Data

Oct. 31, 1985 [FR] France ..... 85 16347

[51] Int. Cl.[4] ..... H01H 3/30

[52] U.S. Cl. ..... 200/153 SC; 200/281; 200/321; 335/171; 185/45

[58] Field of Search ..... 200/153 SC, 153 G, 321, 200/323-325, 280, 281; 335/166, 167, 171, 76; 185/40 B, 45

[56] References Cited

U.S. PATENT DOCUMENTS

| | | | |
|---|---|---|---|
| 2,829,737 | 4/1958 | Favre | 185/37 |
| 3,084,238 | 4/1962 | Baskerville | 200/153 G |
| 3,171,938 | 3/1965 | Pokorny | 200/153 SC |
| 4,027,125 | 5/1977 | Peek | 200/148 R |
| 4,137,436 | 1/1979 | Barkan et al. | 200/153 SC |
| 4,163,133 | 7/1979 | Bould | 200/153 SC |
| 4,439,653 | 3/1984 | Umino et al. | 200/153 SC |
| 4,468,553 | 8/1984 | Kodera et al. | 200/153 SC |
| 4,497,992 | 2/1985 | Kodera et al. | 200/153 SC |
| 4,649,244 | 3/1987 | Baginski et al. | 200/153 SC |

FOREIGN PATENT DOCUMENTS 2558986 8/1985 France .

*Primary Examiner*—Charles E. Phillips
*Assistant Examiner*—Ernest G. Cusick
*Attorney, Agent, or Firm*—Parkhurst & Oliff

[57] ABSTRACT

A stored energy system of a circuit breaker operating mechanism comprises a telescopic link having a guide and a cap with relative movement between which at least one closing spring is inserted. At the end of charging travel, a removable blocking device can be inserted in orifices of the cap and guide to lock the telescopic link. The release of a recharging cam by unlocking a closing pawl then causes a break in the mechanical link with a drive lever, so as to allow the sub-assembly formed by the telescopic link and the closing spring in the compressed state to be removed.

7 Claims, 7 Drawing Figures

CIRCUIT BREAKER OPERATING MECHANISM EQUIPPED WITH A STORED ENERGY SYSTEM HAVING REMOVABLE AND REPLACEABLE CLOSING SPRING MECHANISMS

BACKGROUND OF THE INVENTION

The invention relates to an operating mechanism of a high-rating multipole electrical circuit breaker having a pair of separable contacts per pole and comprising:

a toggle device associated with a trip member and an opening spring to move the moving contact to the open position, charging of the opening spring being carried out automatically when the closing operation is performed, a stored energy system with an elastic device comprising at least one closing spring to move the moving contact to the closed position, charging of the closing spring being performed by a recharging cam driven in rotation by means of a manual lever or a geared motor, a closing pawl controlled by a latching bolt to lock the cam of the stored energy system in the charged position, and to unlock the cam in the discharged position allowing the closing spring to be decompressed, the cam cooperating with a kinematic transmission chain arranged between the stored energy system and the toggle device.

The operating mechanism of the kind mentioned generally permits high-speed closing of a high-current multipole circuit breaker, due to the release of the charging cam brought about by the closing pawl being unlocked. The decompression of the closing spring ensures high-speed closing, and the spring is recharged either manually by means of a charging lever or automatically by an electric motor as soon as the circuit breaker has closed in order to be ready for another operation in the event of opening on a fault. Mechanisms of this kind for high-current circuit breakers require high operating forces which are dependent upon the characteristics and performance required, notably electrodynamic withstand, making capacity, etc . . . . Several types of interchangeable mechanisms having stored energy systems with closing springs of predetermined forces are then indispensable to meet the manufacturing requirements of a range of circuit breakers comprising basic units and units with different performances. This results in an increased mechanism storage volume, and management and production cost problems.

The present invention consists in achieving a standard mechanism for the whole range having a stored energy system with adaptable springs to choose the operating force according to the type of units.

SUMMARY OF THE INVENTION

The operating mechanism according to the invention is characterized by the fact that the stored energy system comprises in addition a telescopic link having two parts with relative movement between which a closing spring is fitted and a removable blocking device capable of locking said telescopic link when the two compression parts of the spring approach one another at the end of charging travel, the release of the cam by unlocking of the closing pawl then causing a break in the kinematic chain with the toggle device in such a way as to allow removal of the sub-assembly formed by the telescopic link and the closing spring in the compressed state.

When the circuit breaker is assembled, the closing spring or springs simply have to be adapted to the type of unit in the range. The springs can be adapted either by adding an extra spring, or by simply changing the stored energy system spring or springs. This operation can be carried out easily without disassembling the standard mechanism.

The telescopic link comprises a guide positioned in a housing of the frame, and cooperating slidingly with a cap mechanically coupled to the kinematic chain when the blocking device is removed from the telescopic link.

At the end of charging travel of the stored energy system closing spring, the telescopic link blocking device can be inserted into the aligned orifices of the cap and the guide, in such a way as to prevent the spring being decompressed when the telescopic link is removed.

BRIEF DESCRIPTION OF THE DRAWINGS

Other advantages and characteristics will become more clearly apparent from the following description of an embodiment of the invention, given as an example only, and represented in the accompanying drawings, in which.

DESCRIPTION OF THE PREFERRED EMBODIMENT

Figure 1:
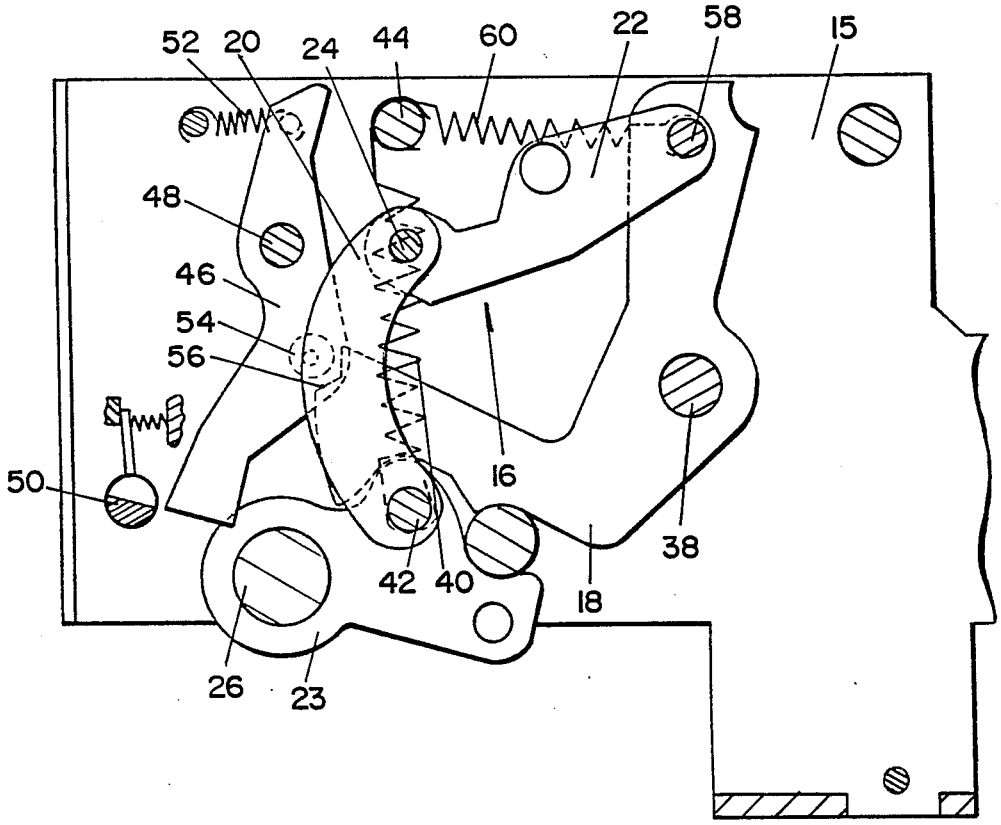
FIG. 1 is a schematic view of the toggle device of the mechanism, represented in the contact open position and in the trip member charged position.

In FIGS. 1 to 5, a multipole electrical circuit breaker having at least one pair of separable contacts 10, 12 per pole is actuated by an operating mechanism 14 supported by a frame with parallel side walls 15 and comprising a toggle device 16 associated with a trip member 18.

The toggle device 16 (FIG. 1) comprises a pair of connecting rods 20, 22 articulated on a pivoting axis 24, the lower connecting rod 20 being mechanically coupled to a transverse switching bar 23, common to all the poles. The bar 23 is constituted by a shaft 26 pivotally mounted between an open position and a closed position of the contacts 10, 12. At the level of each pole a link element 30 is disposed (FIGS. 4 and 5) linking a crank of the bar 23 with an insulating cage 28 supporting the moving contact 12. The latter is connected to a connection terminal pad 32 by a flexible conductor 34, notably a braid. A contact pressure spring 36 is arranged between the cage 28 and the upper face of each moving contact 12.

The trip member 18 is pivotally mounted on a main fixed axis 38 between a charged position (FIG. 1) and a tripped position. An opening spring 40 is secured between a pin 42 of the bar 23 and a fixed retaining catch 44 located above the toggle device 16. An opening pawl 46, formed by a locking lever pivotally mounted on a spindle 48, is controlled by a first half-moon shaped latching bolt 50. A return spring 52 of the opening pawl 46 is located opposite the first bolt 50 in relation to the spindle 48. A stop 54 arranged on the opening pawl 46 between the spindle 48 and the bolt 50, cooperates in the charged position with a V-shaped groove 56 of the trip member 18. The upper connecting rod 22 of the toggle joint 16 is articulated on a spindle 58 of the trip member 18 opposite the groove 56. A return spring 60 fixed between the spindle 58 and the catch 44 biases the member 18 counterclockwise towards the charged position (FIG. 1), in which the stop 54 of the opening pawl 46 is positioned in the V-shaped groove 56 of the member 18.

Figure 2:
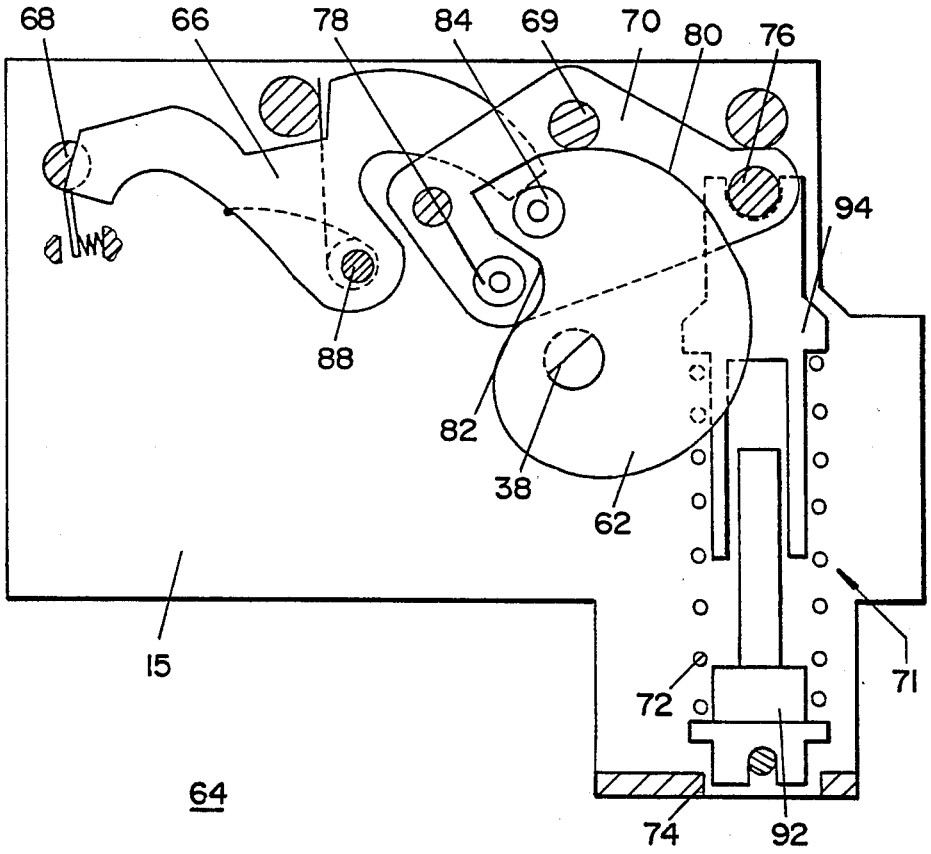
FIGS. 2 and 3 show schematic views of the stored energy system, respectively in the discharged and charged positions of the cam and closing spring.
Figure 3:
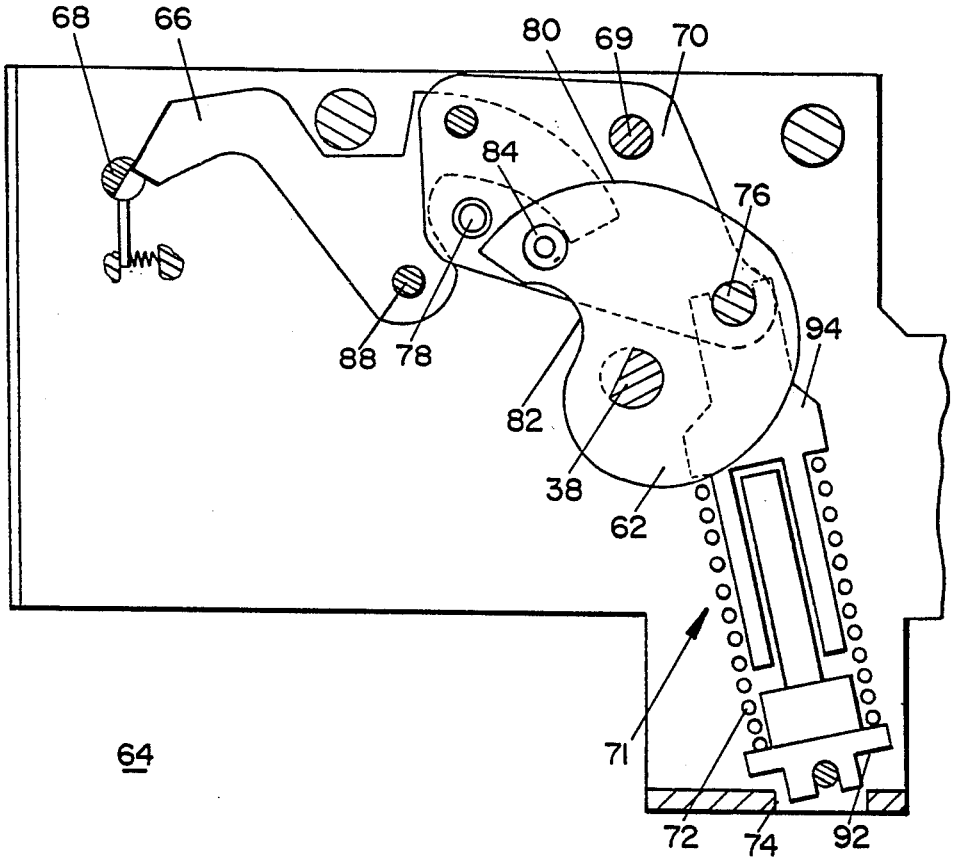
Figure 4:
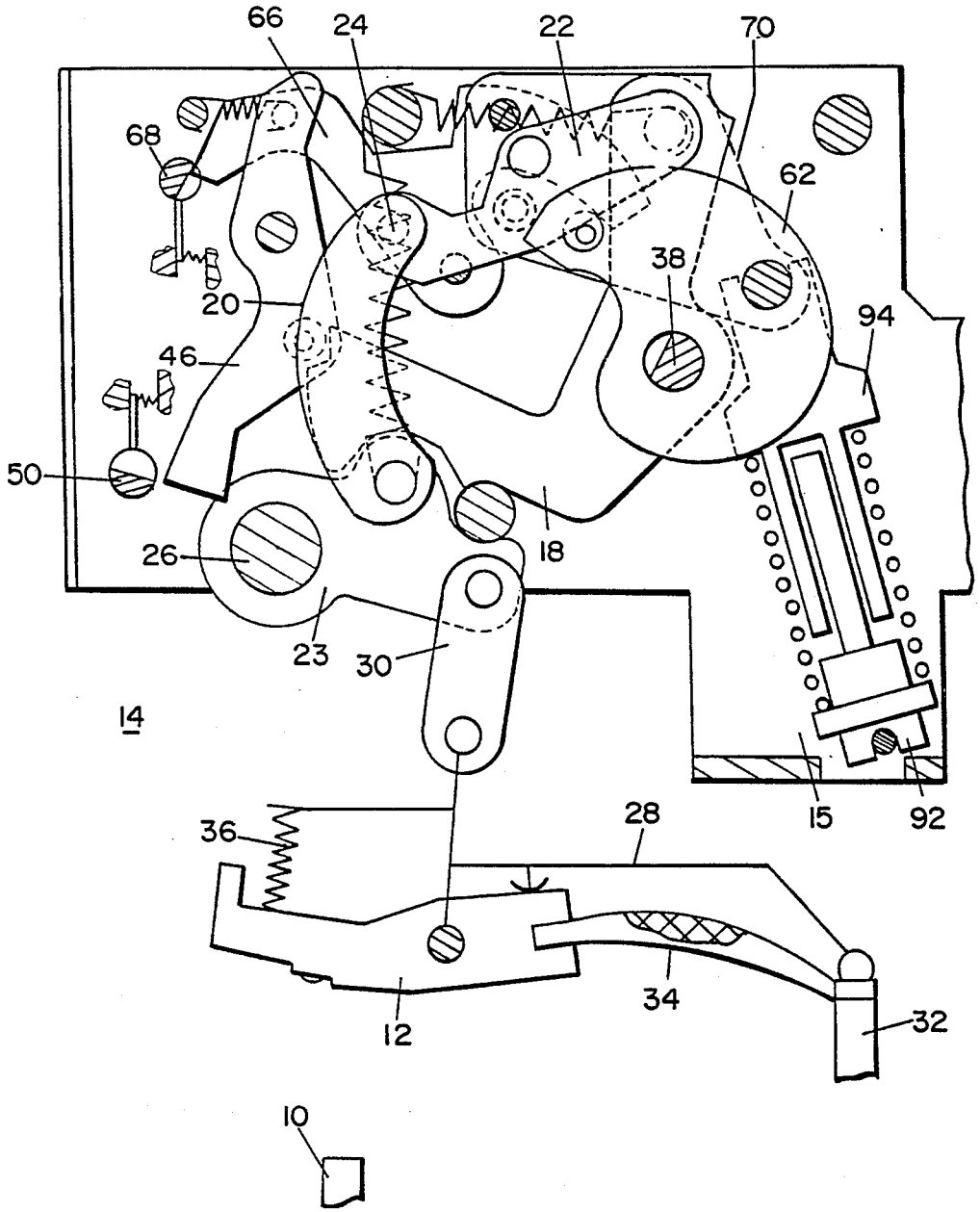
FIG. 4 represents a complete view of the mechanism in the contact open position, and in the stored energy system charged position.

The operating mechanism 14 comprises a recharging cam 62 keyed onto the main axis 38 of the member 18, and cooperating with a stored energy system, shown in detail in FIGS. 2 and 3.

In addition to the recharging cam 62, the stored energy system is equipped with a closing pawl 66 controlled by a second latching bolt 68, and with a drive lever 70 pivotally mounted on a spindle 69. An elastic energy storage device 71, comprising at least one closing spring 72, is fitted between a housing 74 of the frame and a transmission finger 76 of the drive lever 70. The recharging cam 62 cooperates with a roller 78 of the drive lever 70, and the closing spring 72 biases the latter to bear on the cam 62. The profile of the cam 62 comprises a first closing spring 72 charging segment 80, and a second segment 82 corresponding to the release of the roller 78 allowing sudden counterclockwise pivoting of the drive lever 70 due to the action of the closing spring 72 (going from FIG. 3 to FIG. 2). The recharging cam 62 also has a pin 84 capable of coming up against the closing pawl 66 when the end of the first segment 80 of the cam 62 bears on the roller 78 of the drive lever 70.

In the stable position in FIG. 3, the closing spring 72 of the stored energy system 64 is charged, and the contacts 10, 12 are either in the open position or in the closed position, according to state of the toggle device 16 of FIG. 1. The roller 78 bearing on the first segment 80 exerts a torque on the recharging cam 62 biasing the latter in clockwise rotation. The closing pawl 66 opposes this rotation due to the retaining force of the pin 84 of the cam 62.

Figure 5:
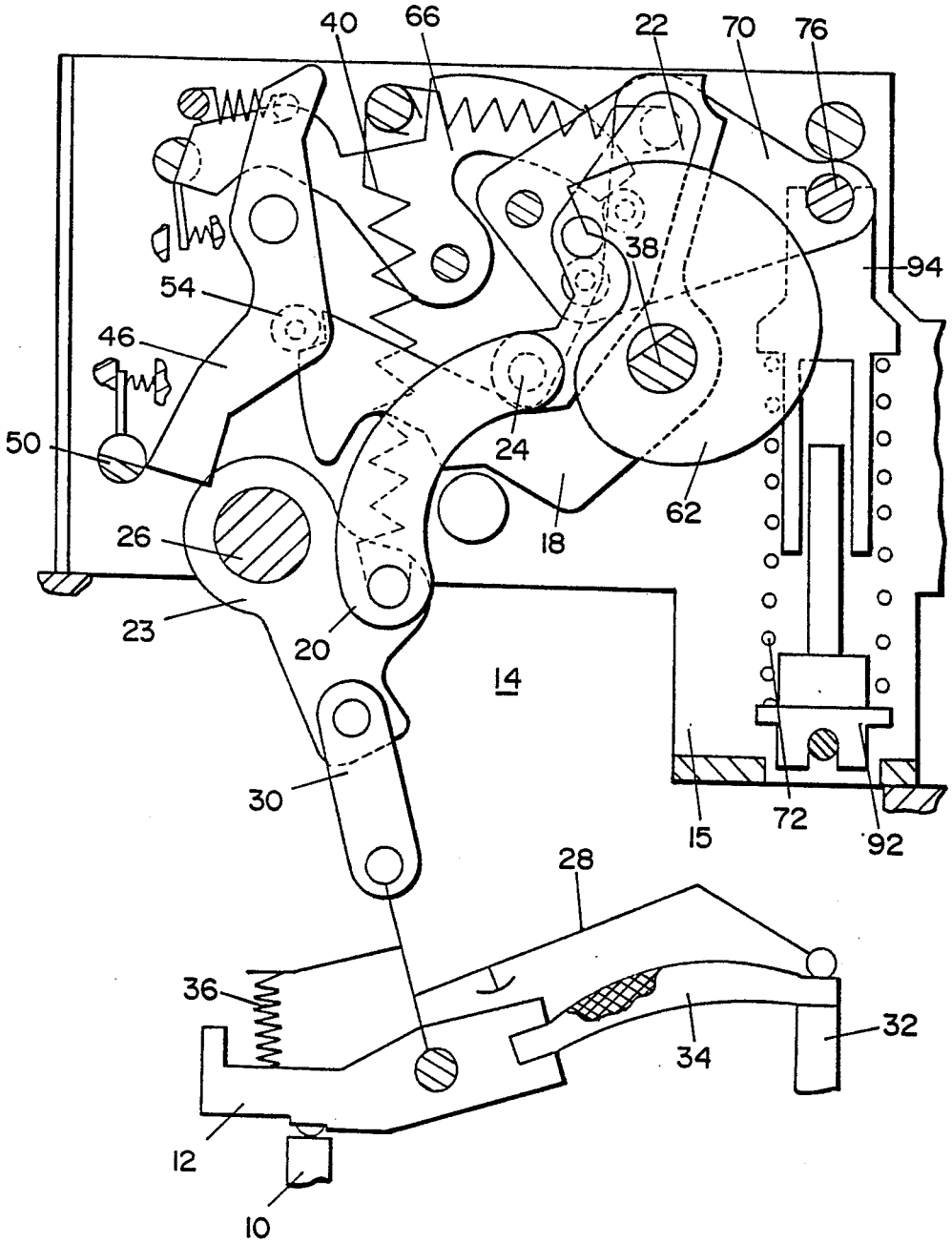
FIG. 5 is an identical view to that of FIG. 4, in the contact closed position, and in the stored energy system discharged position.

The operating mechanism 14 cooperates with a magnetothermal or solid-state trip release (not shown) to bring about automatic opening of the contacts 10, 12 in the event of an overload or a fault occurring. After opening of the contacts 10, 12 by the toggle device 16 (FIGS. 1 to 4), a closing operation can be ordered by actuating the second bolt 68 causing the closing pawl 66 to pivot counterclockwise around its axis 88 (FIG. 2). This results in the pin 84 being released causing clockwise pivoting of the cam 62 due to the action of the roller 78 bringing the second segment 82 of the cam 62 into the release position of the drive lever 70. The latter is then driven counterclockwise by decompression of the closing spring 72 so as to transmit a closing force to the toggle device 16 moving the contacts 10, 12 to the closed position (FIG. 5). This closing operation takes place against the force of the opening spring 40, which is thus automatically charged when the closing spring 72 is decompressed.

Recharging the stored energy system 64 by compressing the closing spring 72 is accomplished manually or automatically by means of an operating lever or a geared motor (not shown) clamped onto the main axis 38. This closing spring 72 recharging operation by rotation of the cam 62 is explained in detail in U.S. Pat. No. 4,649,244 French patent claim No. 2,558,986) filed by the applicant. The main axis 38 is driven in counterclockwise rotation until the pin 84 of the cam 62 comes up against closing pawl 66. The recharging cam 62 turns with the main axis 38 in the same rotational direction, and occupies two stable positions, a charged position (FIG. 3) in which the cam 62 is locked by closing pawl 66, and a discharged position (FIG. 2) allowing the drive lever 70 to be released and the closing spring 72 to be decompressed.

The elastic stored energy device 71 can comprise, depending on the hardness required, a single closing spring (FIGS. 2 to 5) or several coaxial springs 72 (FIGS. 6 and 7) of the spirally-wound compression type. The springs 72 are arranged on a telescopic link 90 comprising a guide 92 positioned in a housing 74 of the frame, and a cap 94 capable of sliding along the guide 92 in cooperation with the transmission finger 76 of the drive lever 70. In normal operation of the mechanism 14, the finger 76 is housed in a notch 104 of the cap 94.

The cap 94 and the guide 92 advantageously have orifices 96, 98 for a blocking device 100 to pass through enabling the telescopic link 90 to be dismantled from the rest of the mechanism.

Fitting the blocking device 100 locks the telescopic link 90 positively and maintains the closing springs 72 in the compressed position preventing them from being decompressed. The blocking device 100 can be formed by a cotter-pin, a peg or a screw capable of passing radially through the aligned orifices 96, 98 of the link 90 when the cap 94 and the guide 92 approach the charged position.

Figure 6:
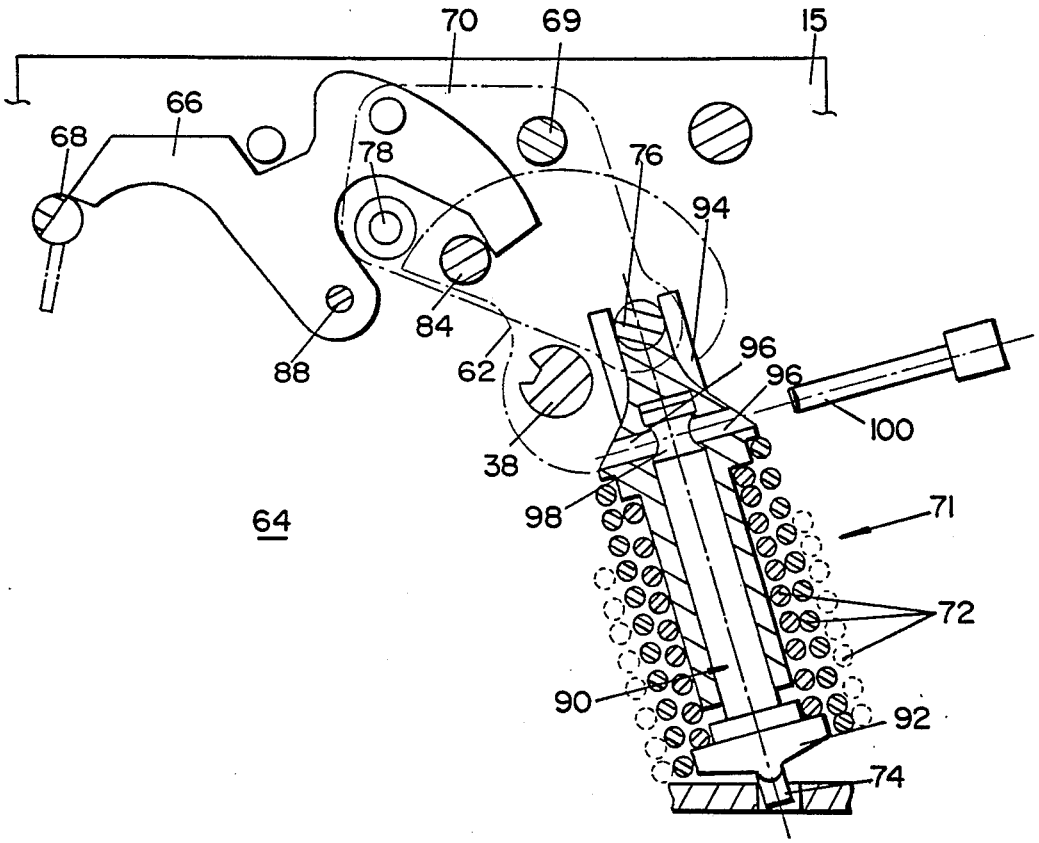
FIG. 6 is an identical view of that of FIG. 3, before the telescopic link blocking device is fitted at the end of the charging travel of the closing springs.
Figure 7:
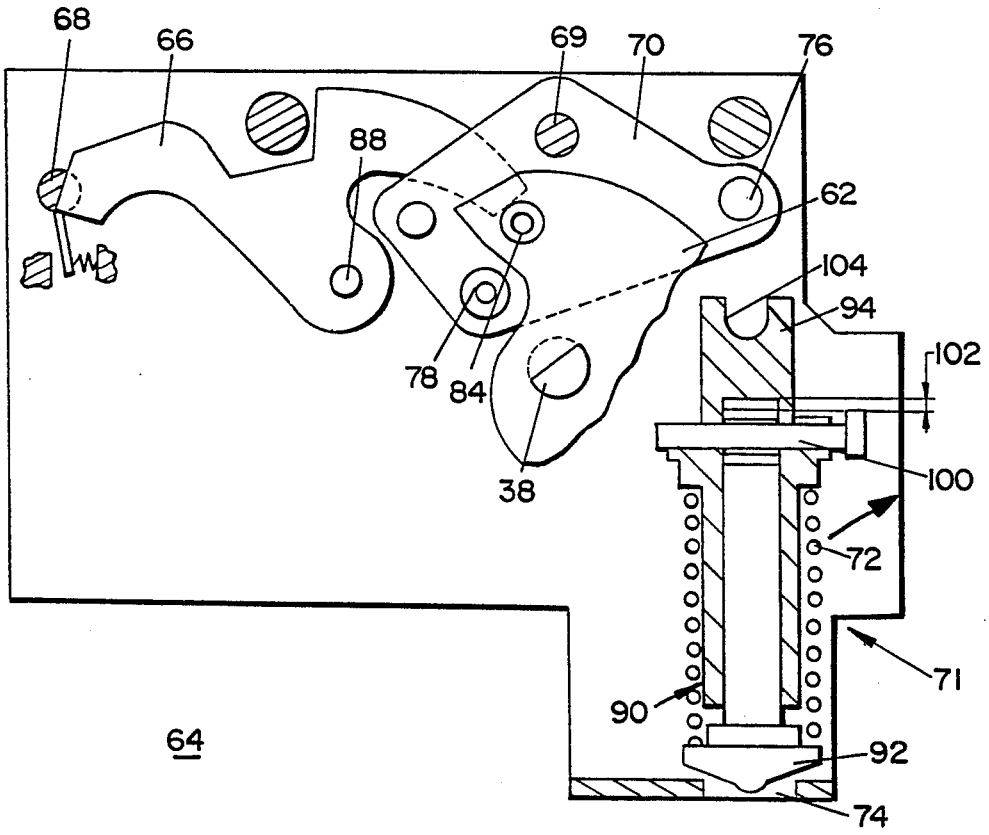
FIG. 7 is a similar view to that of FIG. 2, after the telescopic link blocking device has been fitted, and the recharging cam has been unlocked by the closing pawl.

Fitting the closing springs 72 of the stored energy system 64 is illustrated in FIGS. 6 and 7, and is performed in the following way:

The stored energy system 64 is first actuated to the charged position (FIG. 6) by rotating the main axis 38 and the recharging cam 62. The closing pawl 66 holds the cam 62 in this charged position, and the two springs 72 are in the compressed state. The alignment of the orifices 96, 98 of the cap 94 and guide 92 allows the blocking device 100 to be inserted so as to prevent the telescopic link 90 from subsequently moving apart.

Depressing the closing button of the mechanism 14 then causes the second bolt 68 to be actuated, which unlocks the closing pawl 66 and releases the recharging cam 62. The drive lever 70 pivoting counterclockwise around the spindle 69 causes a break in the kinematic transmission chain or mechanical link between the cap 94 and the transmission finger 76 of the lever 70 (FIG. 7). The assembly comprising the telescopic link 90 and closing springs 72 of the elastic stored energy device 71, can then be removed from the mechanism 14. A small axial clearance 102 remains between the cap 94 and the guide 92 in the inserted position of the blocking device 100.

The presence of the clearance 102 is indispensable to enable the blocking device 100 to be subsequently removed. This operation is performed from outside by means of a vice or a special tool ensuring maximum compression of the springs 72 until the clearance 102 is taken up. After the blocking device 100 has been removed, unlocking the telescopic link 90 allows progressive decompression of the springs 72. Removing the two springs 72 enables them to be replaced by other compression springs of different hardness or a third closing spring 72 to be added (represented by the dashed lines in FIG. 6).

The re-assembly operation of the elastic device 71 is carried out in the reverse order after the new closing springs 72 have been compressed to the maximum and the blocking device 100 has been fitted. The device 7 is refitted in the mechanism 14 by simply positioning the guide 92 in the orifice 74 of the frame, followed by charging the stored energy system 64 (going from FIG. 7 to FIG. 6) so as to re-establish the kinematic transmission chain or mechanical link between the cap 94 and the drive lever 70. The blocking device 100 of the telescopic link 90 is finally removed, and the mechanism 14 is ready to control a circuit breaker closing operation.

Fitting or replacing the closing springs 72 of the stored energy system 64 is accomplished without disassembling the rest of the mechanism 14. It is possible to customize the operating mechanism 14 at the last moment by choosing the hardness of the springs which determines the electrodynamic withstand and the intensity of the closing force. Manufacturing a range of circuit breakers equipped with the operating mechanism 14 can thus be more easily managed, given that the basic units comprise a standard two-spring mechanism, and that an additional spring simply has to be fitted without disassembling the rest of the mechanism to transform the basic unit into a higher-performance unit (improved electrodynamic withstand and making capacity). The ease with which the closing springs 72 can be changed also improves servicing and maintenance of the mechanism 14.

What we claim is:

1. An operating mechanism of a high-rating multipole electrical circuit breaker, each pole having a pair of separable contacts including a movable contact actuated between a closed position and an opened position, said mechanism comprising:

a toggle device associated with a trip member and an opening spring for moving the movable contact towards the opened position, charging of the opening spring being carried out automatically when a closing operation is performed, a stored energy system with an elastic device comprising at least one closing spring arranged to move the movable contact to the closed position, a rotatable recharging cam located in a charged position for charging said closing spring, and in a discharged position for allowing said closing spring to be decompressed, a closing pawl cooperating with a latching bolt to lock the cam in the charged position, and to unlock the cam in the discharged position, a kinematic transmission chain cooperating with said recharging cam and having a drive lever arranged between said stored energy system and the toggle device, a telescopic link of said stored energy system having two parts with relative movement between which said closing spring is fitted, a removable blocking device capable of locking said telescopic link when the two parts approach one another for the compression of said closing spring at the end of charging travel, and a sub-assembly including said telescopic link and the compressed closing spring, which can be removed from the stored energy system upon release of said cam when the closing pawl is unlocked so as to cause a break in the kinematic transmission chain with the toggle device.

2. A circuit breaker operating mechanism according to claim 1, wherein one part of the telescopic link comprises a guide positioned in a frame of the mechanism, and wherein the other part includes a cap cooperating slidingly with the guide, and being mechanically coupled to the drive lever of the kinematic transmission chain when the blocking device is removed from the telescopic link.

3. A circuit breaker operating mechanism according to claim 2, wherein the drive lever is pivotally mounted on a pivoting axis, and is equipped with a transmission finger eccentric in relation to the pivoting axis so that the finger cooperates with a notch arranged in the cap to form a mechanical link capable of breaking said kinematic chain after said blocking device has been fitted.

4. A circuit breaker operating mechanism according to claim 1, wherein the two parts of the telescopic link have orifices capable of being aligned when the closing spring is compressed in the charged position of the cam so as to allow the blocking device to pass through the orifices for locking said link at the end of charging travel.

5. A circuit breaker operating mechanism according to claim 4, wherein an axial clearance of small thickness is arranged between the two parts of the telescopic link after said blocking device has been inserted in the orifices.

6. A circuit breaker operating mechanism according to claim 1, comprising a helicoidal compression closing spring, wherein the blocking device includes a cotter-pin extending transversely in relation to the closing spring when the telescopic link is locked.

7. A circuit breaker operating mechanism according to claim 1, wherein the stored energy system comprises a plurality of spirally-wound closing springs of different diameters which are disposed coaxially on said telescopic link.

* * * * *